US007537120B1

(12) United States Patent
Cardenas

(10) Patent No.: US 7,537,120 B1
(45) Date of Patent: May 26, 2009

(54) SYSTEM FOR A HAIR COLORIST

(76) Inventor: Rey Cardenas, 410 Blanco Ct., San Ramon, CA (US) 94583

( * ) Notice: Subject to any disclaimer, the term of this patent is extended or adjusted under 35 U.S.C. 154(b) by 404 days.

(21) Appl. No.: 11/521,761

(22) Filed: Sep. 15, 2006

(51) Int. Cl.
*B65D 69/00* (2006.01)

(52) U.S. Cl. ..... 206/581; 206/362; 206/425; 220/23.4; 221/210

(58) Field of Classification Search ..... 206/214, 206/224, 349, 371, 425, 449, 581, 1.7, 362, 206/362.2; 220/23.4, 23.83, 23.86, 23.87, 220/23.89; 221/210, 220; 132/120, 148, 132/202, 208
See application file for complete search history.

(56) References Cited

U.S. PATENT DOCUMENTS 2,885,112 A 5/1959 Willat
4,066,171 A * 1/1978 Fowlie ..... 211/69.1
4,412,618 A 11/1983 La Conte
4,417,670 A * 11/1983 Booher ..... 221/210
4,946,066 A * 8/1990 Teitelman ..... 221/210
4,991,738 A 2/1991 Peterson
5,487,466 A * 1/1996 Robson ..... 206/214
5,775,507 A 7/1998 Wood
6,209,748 B1 * 4/2001 Dunbar ..... 220/23.86
6,237,608 B1 5/2001 Kari
6,622,900 B1 9/2003 Barnett
6,811,055 B2 11/2004 Polesuk
2004/0140316 A1 7/2004 Polesuk

* cited by examiner

*Primary Examiner*—Luan K Bui
(74) *Attorney, Agent, or Firm*—The Webostad Firm

(57) ABSTRACT

Equipment for dispensing sheet goods and use of hair coloring solutions, or in other words a system for a hair colorist, is described. An aspect of the invention is a system for a hair colorist including a housing defining a first region capable of receiving one or more sheets of a stack of sheet goods. An indexing device is located on an exterior surface of the housing. A first bowl configured to be mated with the indexing device to restrain movement of the first bowl.

11 Claims, 5 Drawing Sheets

SYSTEM FOR A HAIR COLORIST

FIELD OF THE INVENTION

One or more aspects of the invention generally relate to equipment for dispensing sheet goods and use of hair coloring solutions and, more particularly, to a system for a hair colorist.

BACKGROUND OF THE INVENTION

Conventionally, in order to achieve artistic and realistic hair color, a hair colorist usually uses a number of different hair coloring solutions as applied to different portions of the hair, generally locks or tufts and not individual strands. Notably, hair coloring solutions, which are generally liquid solutions, may have paste-like or pudding-like viscosity, and thus there may be solids or dissolved solids within a hair coloring solution. There are many types of hair coloring solutions including dyes, tints, and bleaches. The term "including" and variations thereof as used herein is meant to be construed as "including without limitation." The application of hair coloring solution may be to highlight, tint, shade, color, or any a combination thereof, the portions of the hair being treated. In some instances, hair coloring is achieved by a gradual progression of application of hair coloring solution or solutions to a portion or portions of the hair being treated. For purposes of clarity by way of example and not limitation, it shall be assumed that dyes, and thus dying, are used, even though as indicated above other types of treatments separate from or in combination with application of a dye may be used.

To separate the several portions of hair being dyed with different dyes, colorists may wrap the individual locks in a sheet material. Examples of sheet material include sheets of a foil ("foils") and sheets of a paper, respectively such as aluminum foil and wax paper. Again, for purposes of clarity by way of example and not limitation, it shall be assumed that foil is used, even though other known types of sheet goods may be used. In use, the colorist applies a quantity of hair coloring solution to a small portion of the client's hair, and then wraps that portion of hair in a foil to inhibit or prevent the dye from contacting adjacent portions of hair, which may be un-dyed or which may have been dyed. The use of foils as described herein also assists maintenance of contact between the dye and the portion of the hair being dyed.

Dyes are typically applied with brushes, but other implements including sponges, tissues, cloths, and the hands of the colorist may also be used. The foils used to separate the several portions of hair are generally of constant width, but may vary in length according to the length of the hair portion being treated.

During a hair coloring session, a colorist may use a plurality of different hair dye shades, each being dispensed from a small container, such as a bowl or cup. Moreover, in order to keep the colors of the several dyes discrete, it is common practice to utilize a different implement, such as a different brush for example, for each dye color.

In practice, a colorist may work in a somewhat crowded workspace, with a client, an array of dye-filled bowls, a corresponding number of dye-covered brushes, and some form of foil with which to wrap the several portions of the client's hair. Accordingly, it would be desirable and useful to provide means to dispense both foils and apply dyes that facilitates use in a relatively small workspace.

SUMMARY OF THE INVENTION

One or more aspects of the invention generally relate to equipment for dispensing sheet goods and use of hair coloring solutions and, more particularly, to a system for a hair colorist.

An aspect of the invention is a kit for a colorist including a housing defining a first region capable of receiving one or more sheets of a stack of sheet goods. An indexing device is located on an exterior surface of the housing. A first bowl configured to be mated with the indexing device to restrain movement of the first bowl.

BRIEF DESCRIPTION OF THE DRAWINGS

Accompanying drawing(s) show exemplary embodiment(s) in accordance with one or more aspects of the invention; however, the accompanying drawing(s) should not be taken to limit the invention to the embodiment(s) shown, but are for explanation and understanding only.

DETAILED DESCRIPTION OF THE DRAWINGS

In the following description, numerous specific details are set forth to provide a more thorough description of the specific embodiments of the invention. It should be apparent, however, to one skilled in the art, that the invention may be practiced without all the specific details given below. In other instances, well-known features have not been described in detail so as not to obscure the invention. For ease of illustration, the same number labels are used in different diagrams to refer to the same items; however, in alternative embodiments the items may be different.

Figure 1:
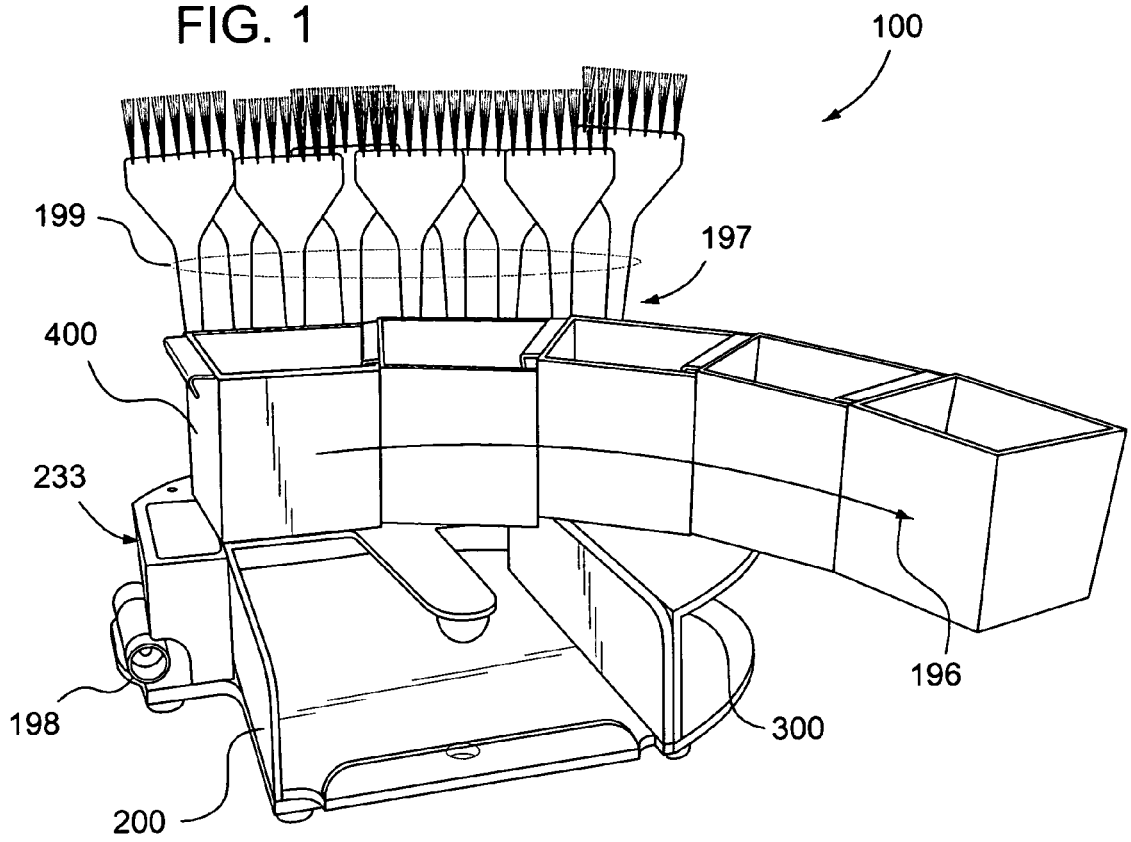
FIG. 1 is a perspective view depicting an exemplary embodiment of a hair colorist workstation which may include a sheet goods carrier, a base station, and bowls.

FIG. 1 is a perspective view depicting an exemplary embodiment of a hair colorist workstation 100. As illustratively shown in FIG. 1, workstation 100 includes a sheet goods carrier, namely foil carrier 200, and a base station 300. Additionally, workstation 100 may include one or more bowls 400. Furthermore, workstation 100 may be sold as a kit with accessories, which may further include one or more brushes 199 or one or more glue sticks 198. Notably, even though each of brushes 199 is illustratively shown in FIG. 1 with a particular orientation, each of brushes 199 may have any orientation. Glue sticks 198 may be used to provide a removable adhesive, as described below in additional detail.

Figure 2:
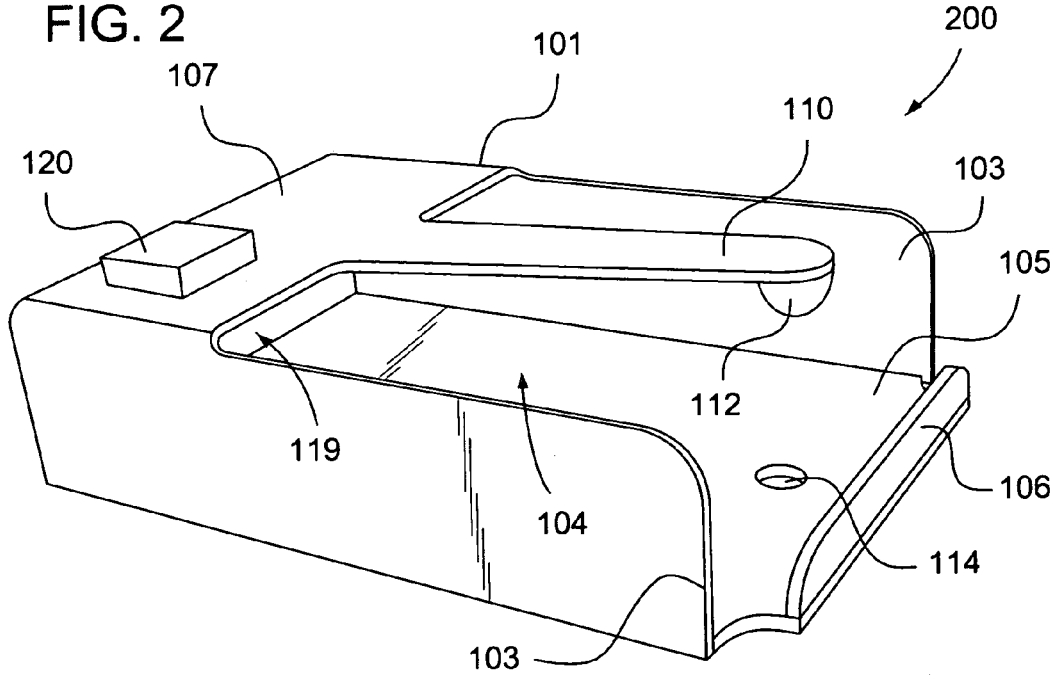
FIG. 2 is a perspective view depicting an exemplary embodiment of the sheet goods carrier of the hair colorist workstation of FIG. 1.

FIG. 2 is a perspective view depicting an exemplary embodiment of sheet goods carrier, namely foil carrier 200. As illustratively shown in FIG. 2, foil carrier 200 includes a carrier body 101, which is a box-like structure including uprights or left and right sidewalls 103, carrier bridge or top 107, and carrier base 105. Carrier body 101 is formed to receive therein at least one and preferably a plurality of precut sheets of material for separating individual portions of hair. This material may include papers, foils, plastics, and other sheets or sheet-like materials known to those having skill in the art. Again, for purposes of clarity by way of example and not limitation, it shall be assumed that sheet material used is sheets of foil or foils. Notably, foils may be provided in a stack, which may or may not be in an open-top box. For purposes of clarity by way of example and not limitation, it shall be assumed that foils are not provided in an open-top box unless otherwise indicated.

Optionally, at the front of carrier body 101 may be located an end wall or lip 106 extending upward from carrier base 105. Lip 106 may be to assist in retaining foils within a foil cavity or region 104 defined at least in part by right and left sidewalls 103 and carrier base 105. Optionally, an end wall or lip, not illustratively shown in FIG. 2, may be located at the rear of carrier body 101 extending upward from carrier base 105. Alternatively, an end wall at the rear of carrier body 101 may be omitted and the rear portion of carrier body 101 may remain open, as indicated by opening 119, to facilitate replenishment of foils into foil region 104.

In an embodiment, right and left sidewalls 103 are coupled or connected to carrier base 105 and to carrier top 107. Notably, carrier top 107 leaves a substantial upper portion of foil region 104 open to provide access to foils, such as for dispensing one foil at a time of foils, not shown, located within foil region 104. Additionally, lip 106 may be substantially lower than a full stack of foils, not shown, located in foil region 104, likewise such as for dispensing one foil at a time.

Foil carrier 200 may be movably retained within base station 300 of FIG. 1 by means of latches, detents, fasteners, connectors, or other mechanically removable attachment means known to those having skill in the art. In an embodiment, a detent hole or recess 114 extending to or on the under side of carrier base 105 is for removably engaging with a detent pin or bump of base station 300, described below in additional detail.

With continuing reference to FIG. 2, foil lifter arm 110 is described. Foil lifter arm 110 is an elastically deformable member extending generally forward from a generally rearward mounted position of carrier top 107. In the example embodiment illustratively shown in FIG. 2, foil lifter arm 110 is formed in conjunction with carrier top 107 of foil carrier 200. Foil lifter arm 110 is elastically deformable in a downward direction by an operator. Optionally formed substantially near to a forward or distal end of foil lifter arm 110 is knoblike structure 112. Knoblike structure 112 is for receiving thereon a quantity of releasable adhesive, and for contacting an upper one of a plurality of foils, not illustratively shown in FIG. 2, contained within foil region 104. Use of foil lifter arm 110 is described below in additional detail. Furthermore, as described below in additional detail, foil lifter arm 110 need not be part of foil carrier 200, but may be part of base station 300, as described below in additional detail.

To align a bowl 400 with base station 300 of FIG. 1, an indexing device may be used to allow such a bowl 400 to be removably engaged with such indexing device. In this example embodiment, a substantially square or rectangular bowl lug 120 is for engaging with a similarly shaped recess on the bottom of at least one of bowls 400. Notably, known shapes other than square and rectangles may be used. In an embodiment, bowl lug 120 may be positioned on an upper portion of carrier top 107. In alternative embodiments, bowl lug 120 may be placed on an upper surface of base station 300.

Figure 3A:
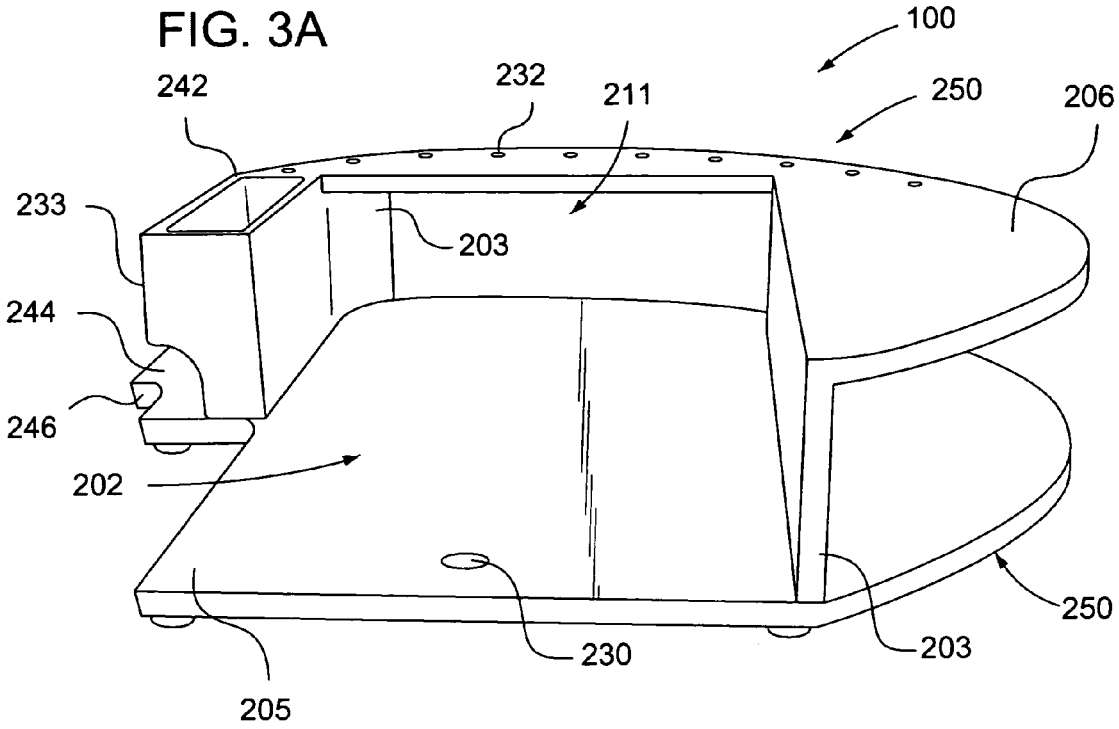
FIGS. 3A and 3B are perspective views depicting an exemplary embodiment of the base station of the hair colorist workstation of FIG. 1.
Figure 3B:
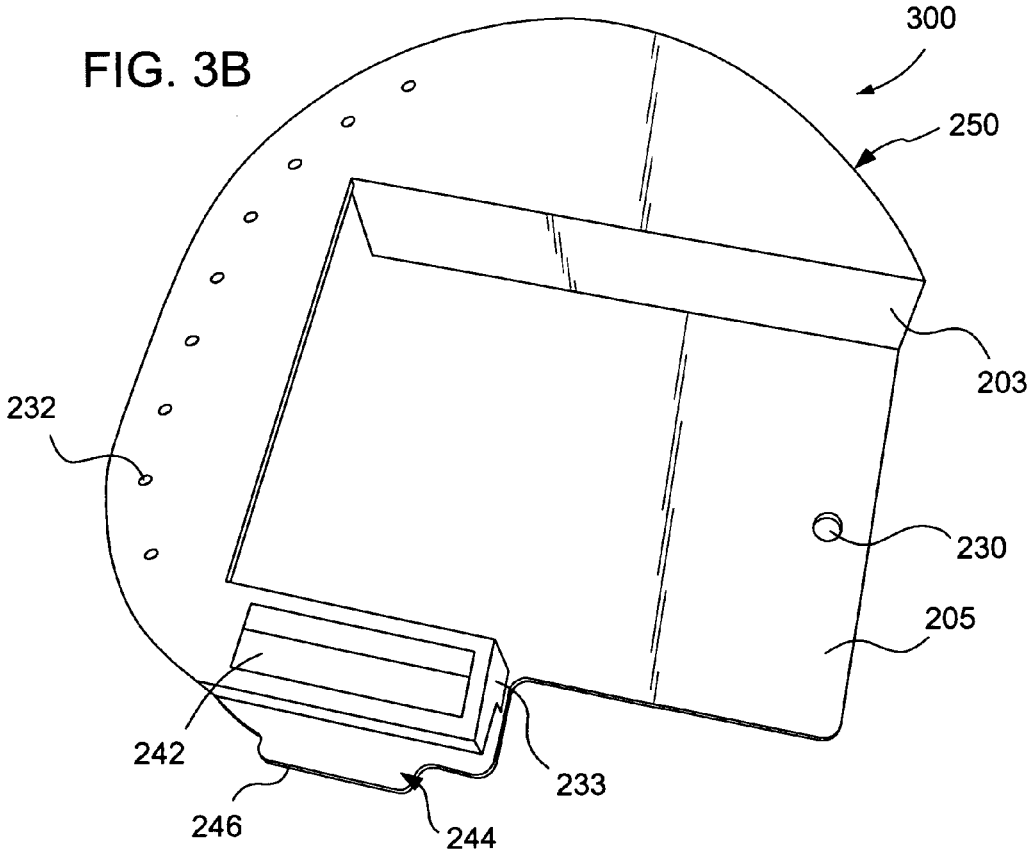

FIGS. 3A and 3B are perspective views depicting an exemplary embodiment of base station 300. Base station 300 may include a station floor 205 and one or more of chamber sidewalls 203 extending upward from station floor 205. Optionally, base station 300 may include one or more front or rear end walls, not illustratively shown in FIG. 3 except that optionally a left chamber sidewall 203 may extend to the rear of base station 300 to narrow rear opening 211 as illustratively shown in FIG. 3A.

Station floor 205 and chamber sidewalls 203 define at least in part carrier region 202, which may be used for example to receive therein foil carrier 200 of FIG. 2. Right and left sidewalls 203 may couple station floor 205 and station top 206. Opening 211 in combination with opening 119 of foil carrier 200 of FIG. 2 may be used to allow foils, which may be longer than carrier region 202, to extend out the back of base station 300.

Notably, carrier region 202 is substantially open on the top for facilitating placing foil carrier 200 of FIG. 2 therein. In the example embodiment illustratively shown in FIGS. 3A and 3B, a detent bump or pin 230 is located on an upper surface of station floor 205 for removable engagement with detent hole or recess 114 of foil carrier 200 of FIG. 2. Alternative latching and retaining devices known to those having ordinary skill in the art may alternatively be employed. These include but are not limited to couplers, mounts, clamps, latches, locks, lugs, and the like.

In the example embodiment, one or more accessories or accessory features for further organizing a colorist's materials may be implemented. One or more brush holder holes 232 may be defined by a station top 206.

Notably, station top 206, as well as station floor 205, may optionally generally have a hairstyle-shaped profile 250. In the example embodiment illustratively shown, hairstyle-shaped profile 250 is for an asymmetric "bob" hairstyle. Notably, an asymmetric "bob" hairstyle has a similar arc shape portion as does an artist paint palette, and thus may be used to enhance the palette effect. However, other known hairstyle profiles may be used. Furthermore, station top 206 may be detachable from the remainder of base station 300, in which embodiment any of a variety of hairstyle shaped profiles of station ceilings accessories may be attached as part of base station 300. These accessory station ceilings may be individually sold or may be sold in groups associated with current hairstyle trends.

With simultaneous reference to FIGS. 1, 3A, and 3B, brushes 199 may have tapered handles 197 for removable engagement with brush holder holes 232. Furthermore, handles 197, which in part extend below station top 206 when seated, may still be sufficiently long such that a colorist may remove them from and replace them in brush holder holes 232 relatively easily. In short, handles 197 may be sufficiently long such that they extend above rims of bowls 400 when coupled to base station 300 to facilitate easy removal and replacement of brushes 199. Notably, various selections of brushes 199 may be sold as part of a kit to provide at least those types of brushes more readily used by a colorist.

Another accessory illustratively shown in the exemplary embodiments of FIGS. 1 and 3 is an adhesive dispenser 233. Adhesive dispenser 233, which may be formed as being joined to or as part of a left sidewall 203, may be for holding one or more glue sticks, such as glue stick 198. As described below in additional detail, a quantity of releasable adhesive, such as from glue stick 198, may be utilized for the operation of foil lifter arm 110 of FIG. 2 for example. Adhesive dispenser 233 may thus serve as a site for both storing and dispensing one or more containers of a removable adhesive utilized in the operation of foil lifter arm 110 of FIG. 2 for example.

In the example embodiment illustratively shown, adhesive dispenser 233 takes the form of a substantially rectangular box having an upper aperture, namely dispenser gate 242, and a lower aperture, namely dispenser output 244. Individual ones of tubes of releasable adhesive may be inserted into adhesive dispenser 233 through dispenser gate 242 and may, to suit a user's needs, be removed from dispenser output 244 manually. Tubes of releasable adhesive are retained in dispenser 233 by means of a dispenser lip 246 formed on a lower exterior portion of dispenser output 244.

With simultaneous reference to FIGS. 1, 2, 3A, and 3B, workstation 100 of FIG. 1 is further described. Foil carrier 200 is receivable into and out of base station 300. In the example embodiment illustratively shown, foil carrier 200 may be slid into and out of carrier region 202, and may be retained therein in part by means of detent bump or pin 230 engaging detent hole or recess 114 of foil carrier 200. Notably, in the embodiment illustratively shown, foil carrier 200 may be generally slid in to position via the upper front portion of base station 300. However, in an alternate embodiment, where rear opening 211 is sufficiently large to receive foil carrier 200, foil carrier 200 may be slid in and out through the back of base station 300 via rear opening 211 in addition to entry and exit from the upper front portion thereof.

Figure 4:
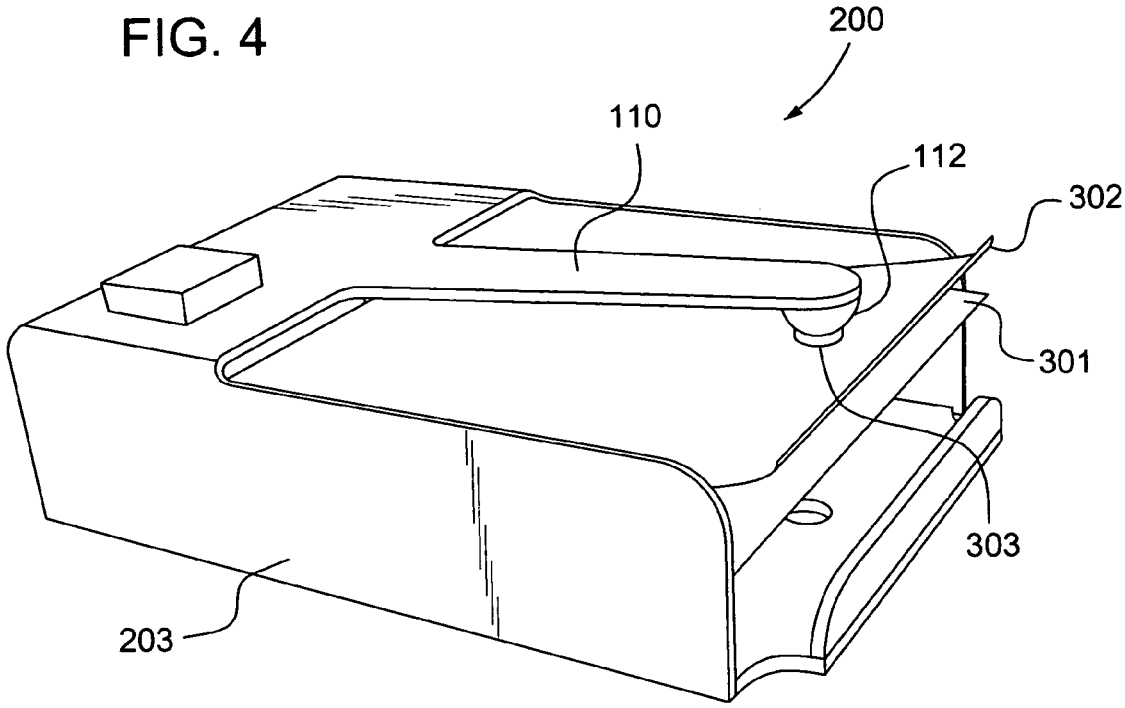
FIG. 4 is the perspective view of FIG. 2 with the addition of two pieces of sheet goods, such as foils, loaded into the sheet goods carrier.

FIG. 4 is the perspective view of FIG. 2 with the addition of two pieces 301 and 302 of sheet goods, such as foils, loaded into foil carrier 200. Though only two foils are illustratively shown, it should be understood that many more than two foils may be loaded into foil carrier 200.

Removable adhesive 303, such as glue from glue stick 198 of FIG. 1 or other known tacky substance that may be applied for pulling up sheet goods, may be placed on an underside of knoblike structure 112. A colorist, or other operator, may press down on foil lifting arm 110 to cause contact between removable adhesive 303 and an upper surface of an uppermost foil 302. By lifting up or releasing foil lifting arm 110, the colorist may separate the uppermost foil 302 from the one beneath it, namely foil 301. Foil 302 may thus at least temporarily adhere to removable adhesive 303 for a sufficient time for removal of foil 302 from foil carrier 200 for use thereof.

Notably, it should be appreciated that even though knoblike structure 112 as illustratively shown herein has a dab of removable adhesive 303 applied to it, alternative configurations may be used. For example, knoblike structure 112 may be made out of a sponge or sponge-like material for retaining an amount of a hair, such as water, and thus water rather than a removable adhesive may be used. Furthermore, for sheet goods that have a degree of magnetic property, a magnet may be used for knoblike structure 112 without use of removable adhesive. Moreover, knoblike structure 112 may be a material suitable for having electrostatic energy, and may be coupled to an electrical source such as a battery (not shown), for electrostatic coupling with an uppermost sheet good. The configuration used for coupling knoblike structure 112 to and uppermost sheet good may therefore be any of a variety of configurations for generally reliably dispensing a single sheet at a time of the sheet material used.

Figure 5A:
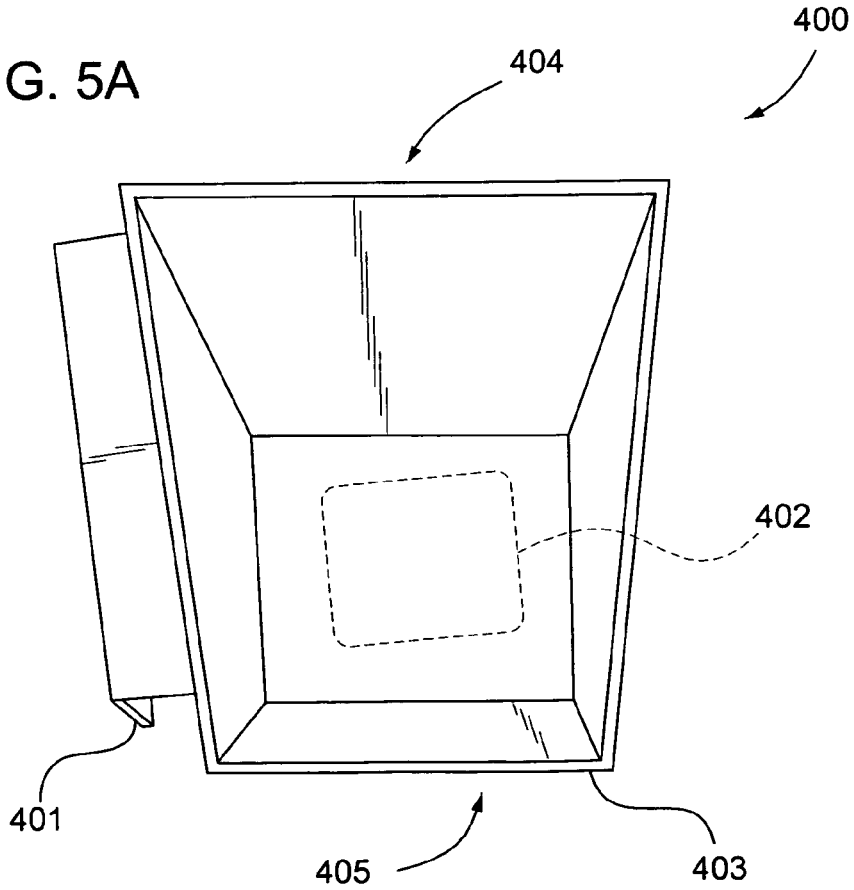
FIG. 5A is a top perspective view depicting an exemplary embodiment of a bowl, such as one of the bowls of FIG. 1.
Figure 5B:
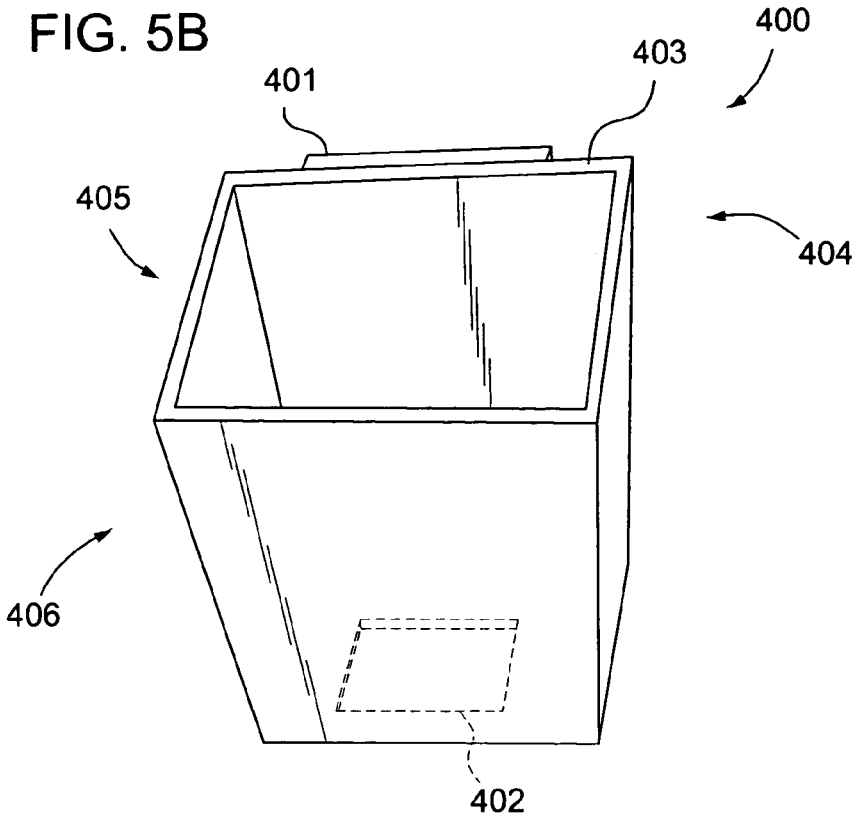
FIG. 5B is a side perspective view depicting an exemplary embodiment of the bowl of FIG. 5A.

FIG. 5A is a top perspective view depicting an exemplary embodiment of a bowl 400, and FIG. 5B is a side perspective view depicting an exemplary embodiment of the bowl 400 of FIG. 5A. With simultaneous reference to FIGS. 1, 5A, and 5B, bowls 400 of FIG. 1 are further described.

At least one of bowls 400 may have formed thereunder a recess 402 as indicated by dashed lines in FIGS. 5A and 5B. Recess 402 is for removable engagement with bowl lug 120 of FIG. 2, and thus likewise may have a generally corresponding shape to that of bowl lug 120 of FIG. 2.

Upper openings of one or more of bowls 400 may have a shape that promotes bowls 400 forming an arc, as generally indicated by arrow 196 of FIG. 1, when two or more bowls 400 are coupled to one another. In the example embodiment illustratively shown, bowls 400 have a rim 403 of a trapezoidal or trapezoidal-like shape, where a back width 404 is wider than a front width 405. Difference in widths 404 and 405 is exaggerated in FIG. 5A for purposes of clarity and not limitation. Notably, although portions of rim 403 associated with such widths are illustratively shown as straight in FIGS. 5A and 5B, such portions need not be straight, but may be arced for example. Additionally, each of bowls 400 may be generally the same configuration, shape, and size to promote interchangeability. Furthermore, each of bowls 400 may have a retrograde profile, such as retrograde profile 406 at a front side of bowl 400 of FIG. 5B, such that each of a lower portion of bowls 400 fits into each of an upper portion of bowls 400 for enhanced ability to stack bowls 400 one on top of another.

Accordingly, it should be appreciated that with multiple bowls 400 coupled to one another and an indexing bowl 400 coupled to foil carrier 200 via recess 402 being fitted to bowl lug 120, whether foil carrier is or is not disposed in base station 300, a colorist's palette may be provided by placing different dyes in the various bowls 400. This palette effect is further facilitated by having bowls 400 coupled in series forming an arc, as generally indicated by arrow 196 of FIG. 1. Furthermore, brushes 199 may have colored handles or otherwise have different colors for color coding of dyes to brushes. Alternatively, bowls 400 may be color coded, or both bowls 400 and brushes 199 may be color coded with each other. Another alternative is to have bowls 400 made of a generally clear material for enhanced ability to view the color of the dye therein.

Bowls 400 may be coupled to one another via any of a variety of known mechanical fasteners. In the example embodiment illustratively shown in FIGS. 1, 5A, and 5B, bowls 400 may have a bar hook 401 attached to or formed with bowls 400. In the example illustratively shown in FIGS. 1, 5A, and 5B, each of bowls 400 has a bar hook 401 on a left side thereof for removable engagement with a right side of an adjacent bowl 400, and more particularly to be hooked over a portion of a rim of a right-side adjacent bowl 400. However, it should be appreciated that not every bowl 400 need have a bar hook 401. In particular, the first or leftmost bow in the example of FIG. 1 need not have a bar hook 401. Furthermore, even though the example colorist workstation 100 of FIG. 1 is for a right-handed colorist, it should be appreciated that workstation 100 of FIG. 1 may alternatively be manufactured for left-handed colorists. Additionally, with reference to FIG. 1, when bowls 400 are coupled to base station 300 and coupled to one another in series, a portion or all of a lastly coupled or distal bowl 400 of such series may extend over the edge of an upper exterior surface of base station 300. Notably, series of bowls 400 need not entirely rest upon the upper exterior surface of base station 300.

Figure 6A:
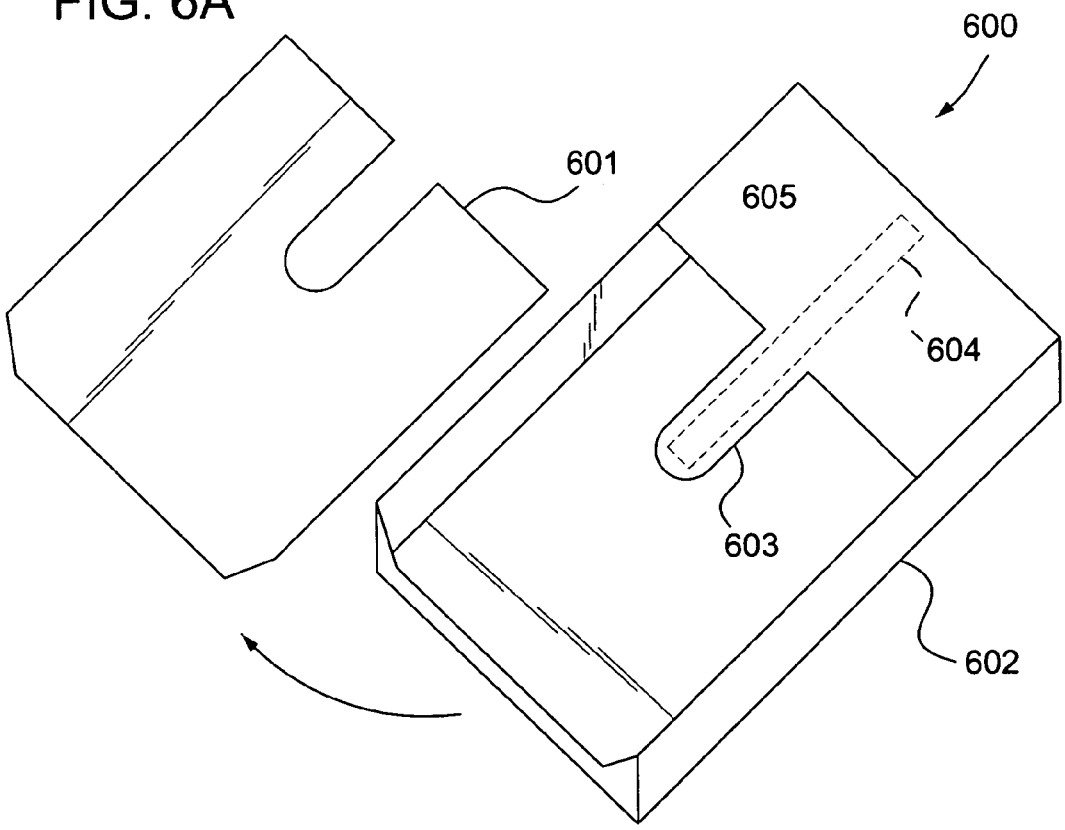
FIG. 6A is a top side perspective view depicting an alternate exemplary embodiment of a foil carrier.

FIG. 6A is a top side perspective view depicting an alternate exemplary embodiment of a foil carrier 600. As foil carrier 600 is similar in many respects to foil carrier 200 of FIG. 2, much of the common description is not repeated for purposes of clarity. Foil carrier 600 is initially provided as a box, where tear-away portion 601 is removed from foil holder portion 602. Removal of tear-away portion 601 may be facilitated by perforations in of the box. Accordingly, foil carrier 600 may be formed using a readily disposable material, and preferably a recyclable or renewable material, such as cardboard or other paper product.

Part of foil holder portion 602 may be foil lifter arm 603. Foil lifter arm 603 may or may not have a knoblike structure as previously described with respect to knoblike structure 112 of foil lifter arm 110 of FIG. 2. A firm though flexible strip 604, which has a spring-like quality of being able to be pressed down upon and generally return to it original position, may be attached to an underside of a top 605 of holder portion 602. Alternatively, strip 604 may be inserted in between outer surfaces of the material used to form holder portion 602, such as cardboard. General examples of materials suitable for strip 604 include metal and plastic. Strip 604 extends at least a substantial portion of the length of top 605, as well as extending at least a substantial portion of the length of foil lifter arm 603.

Figure 6B:
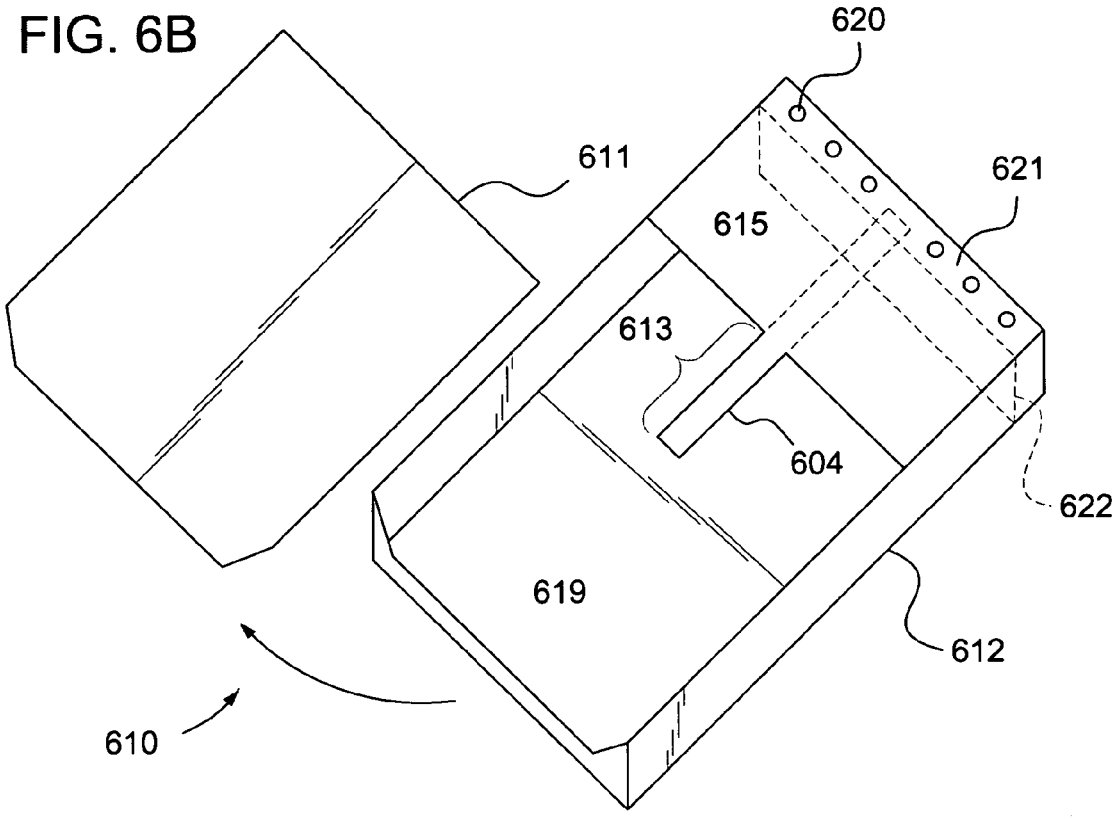
FIG. 6B is a top side perspective view depicting another alternate exemplary embodiment of a foil carrier.

FIG. 6B is a top side perspective view depicting an alternate exemplary embodiment of a foil carrier 610. As foil carrier 610 is similar in many respects to foil carriers 200 and 600 of FIGS. 2 and 6, respectively, much of the common description is not repeated for purposes of clarity. Foil carrier 600 includes tear-away portion 611 and holder portion 612. Strip 604 is attached to an underside of a top 615 of holder portion 612. In this exemplary embodiment, the material used for boxing foils that extends over a portion of strip 604 is removed, namely is part of tear-away portion 611. This leaves an uppermost surface of a portion of strip 604 exposed after removal of tear-away portion 611 to provide foil lifter arm 613.

Optionally, holder portion 612 may have formed therein holes 620 for receiving handles of implements, such as brushes as previously described. To prevent seated handles from damaging foils in holder portion 612, a membrane 622 may be located toward the rear of holder 612 for defining an interior region 621 for receiving distal ends of implement handles. Thus, membrane 622 may separate interior region 621 from a foil-holding region 619 of holder portion 612.

Figure 7:
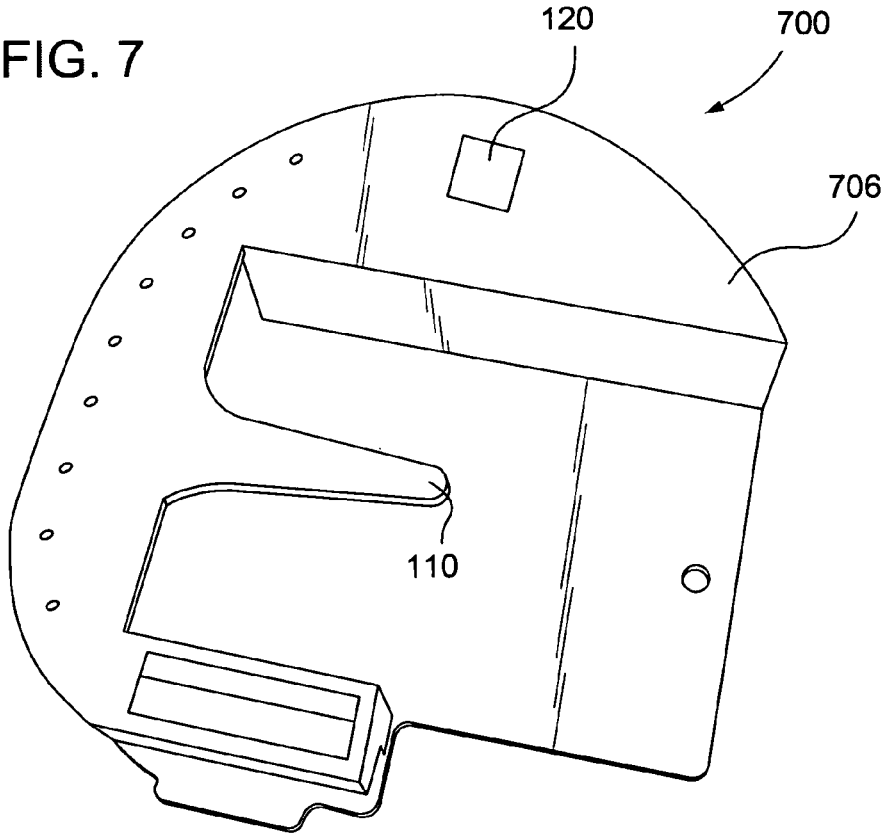
FIG. 7 is a top perspective view depicting an exemplary alternate embodiment of a base station.

FIG. 7 is a top perspective view depicting an exemplary alternate embodiment of a base station 700. As base station 700 is similar in many respects to base station 300 of FIG. 3A, much of the common description is not repeated for purposes of clarity.

Station top 706 of base station 700 has attached thereto or formed therewith foil lifter arm 110, such as was previously described with reference to FIG. 2. Optionally, an upper surface of station top 706 may have attached thereto or formed therewith bowl lug 120, such as was previously described with reference to FIG. 2. Notably, as illustratively shown in this example embodiment, bowl lug 120 may be located on a right side of station upper exterior surface 706 for bowls 400 configured with a bar hook 401 on a right side thereof as described above. Thus, this configuration may be for a left-handed colorist.

Base station 700 may be for a box of foils, such as is commonly available. A tear-away portion of such boxes, similar to tear-away portion 611 for example, may be removed for use with base station 700. Furthermore, a front end wall, like lip 106 of FIG. 2, may be part of the station floor of base station 700, though not illustratively shown in this FIG. 7.

While the foregoing describes exemplary embodiment(s) in accordance with one or more aspects of the invention, other and further embodiment(s) in accordance with the one or more aspects of the invention may be devised without departing from the scope thereof, which is determined by the claim(s) that follow and equivalents thereof. Claim(s) listing steps do not imply any order of the steps. Trademarks are the property of their respective owners.

What is claimed is:

1. A system for a hair colorist, comprising:

a housing;

a sheet goods holder;

the housing defining a first region for receiving the sheet goods holder;

the sheet goods holder having a downward depressible arm configured to return at least approximately to an original position thereof;

the sheet goods holder defining a second region capable of receiving a stack of sheet goods;

the downward depressible arm capable of being depressed for movement in the second region;

an indexing device located on an exterior surface of the housing or the sheet goods holder;

a first bowl configured to be mated with the indexing device to restrain movement of the first bowl;

the housing or the sheet goods holder defining holes for receiving respective end portions of implement handles into a third region when seated in the holes; and the third region being separate from the second region.

2. The system according to claim 1, further comprising a knoblike structure attached to an underside of the downward depressible arm at least approximately at a distal end thereof.

3. The system according to claim 2, further comprising a removable adhesive for application to an underside of the knoblike structure, the downward depressible arm being depressible for contacting an uppermost sheet of the stack of sheet goods.

4. The system according to claim 3, wherein the sheet goods holder is formed of a paper product.

5. The system according to claim 4, further comprising a glue stick dispenser attached to the housing for storing the removable adhesive.

6. The system according to claim 1, further comprising:

brushes having the implement handles; and the implement handles when seated in the holes extending in a vertical direction above a rim of the first bowl when mated with the indexing device.

7. The system according to claim 1, further comprising a second bowl, the second bowl configured for being engaged with a portion of a rim of the first bowl, wherein the housing, the first bowl, and the second bowl provide a palette for the colorist.

8. The system according to claim 1, further comprising a plurality of second bowls, each of the second bowls being configured for being engaged with a portion of a rim of an adjacent bowl to one side thereof, wherein the first bowl and the second bowls are capable of being coupled to one another in a series for providing a palette for the colorist when combined with the housing or the sheet goods holder.

9. The system according to claim 8, wherein each of the first bowl and the second bowls is shaped to provide in combination an arc or arc-like curve responsive to the series to provide a palette when combined with the housing or the sheet goods holder.

10. The system according to claim 9, wherein the rim of each of the first bowl and the second bowls has a trapezoidal or trapezoidal-like shape.

11. The system according to claim 9, wherein each of the first bowl and the second bowls has a retrograde structure going from the rim to a base of each for compact stacking of one partially within another of the first bowl and the second bowls.

* * * * *